United States Patent [19]

Carlin

[11] Patent Number: 4,681,380

[45] Date of Patent: Jul. 21, 1987

[54] METHOD FOR PROVIDING WALL STORAGE

[76] Inventor: Bruce Carlin, 9 D Childs Rd., Bernardsville, N.J. 07924

[21] Appl. No.: 794,828

[22] Filed: Nov. 4, 1985

[51] Int. Cl.[4] ..... A47B 67/02

[52] U.S. Cl. ..... 312/242

[58] Field of Search ..... 312/242; 144/144 R, 144/144.5 R; 33/197, 528

[56] References Cited

U.S. PATENT DOCUMENTS

| | | | |
|---|---|---|---|
| 2,166,430 | 7/1939 | Green | 312/242 |
| 2,887,776 | 5/1959 | Eisner | 33/197 |
| 3,067,822 | 12/1962 | Hattenhauer | 312/242 |
| 4,076,350 | 2/1978 | Crist | 312/242 |

*Primary Examiner*—Lowell A. Larson
*Attorney, Agent, or Firm*—Ronald G. Goebel

[57] ABSTRACT

A method for providing a storage compartment in a wall having equally spaced studs located therein is provided by the invention which employs a cabinet having side walls, a top wall, a bottom wall, and a back wall, the side walls, top wall and bottom wall having a depth no greater than the depth of the studs. A rim portion extends around the perimeter defined by the side walls, top wall and bottom wall. Means for securing the cabinet to the studs are located on the rim portion. Shelves can be located between the side walls and hinge means for hingedly supporting a door on the cabinet. The storage compartment is ideal as a pantry, a broom closet, or a storage locker.

2 Claims, 4 Drawing Figures

METHOD FOR PROVIDING WALL STORAGE

BACKGROUND OF THE INVENTION

This invention is concerned with a method for providing a storage compartment in a wall having equally spaced studs located therein.

Most residential homes built since about 1950 have inside walls made of sheetrock or other similar material and wall supports consisting of wood or metal studs extending vertically between the inner sheetrock wall and outer wall. These studs are spaced apart about 16 inches, center to center, are about 2 inches thick and about 4½ inches in depth. Thus the space between studs would form an ideal storage space heretofore unutilized. Moreover, such space is available for storage from the floor to the ceiling provided there are no wires or pipes as obstructions in the space.

There have been apparatus used heretofore to accomodate that space. For example, in U.S. Pat. No. 3,466,106 there is described cabinet structures which comprise two or more interconnected individual cabinets adapted to fit within the spaces or recesses between adjacent studs. A connecting strip connects individual cabinets and lies over the stud. The cabinet locks into the stud by means of inturned flanges of interlocking ribs which engage saw cuts in the studs. Similarly in U.S. Pat. No. 2,752,217 there is shown a cabinet designed to be mounted in a wall between two studs or other vertical members. The side walls of the cabinet lying against the studs are provided with special recesses which allow fasteners to be inserted from the front of the cabinet.

However, although specific cabinet structures have been disclosed in the art which can be placed in a wall space the art has not disclosed a general method for utilizing the available storage area between studs in homes built after about 1950. The present invention, on the other hand, does provide such a method which can be carried out efficiently, economically, and effectively.

SUMMARY OF THE INVENTION

In brief, the invention deals with a method for providing a storage compartment between the studs of a wall which are spaced apart about 16 inches center to center, are about 2 inches thick and are about 4½ inches in depth. A cabinet is provided for that storage compartment having side walls, a top wall, a bottom wall and a back wall. The distance between side walls is the same as the distance between studs, end to end, or 14 inches. A rim protrudes outwardly about an inch around the perimeter of the open compartment formed by the aforementioned walls. There are screw holes located at the corners of the rim for receiving screws. The inside walls may be optionally equipped with shelf supports along their length for supporting adjustable shelves. The back wall may have hooks located therein for hanging articles. The rim may also have door hinges mounted thereon for receiving a cabinet door. The height of the cabinet may be between about 2 feet and 6 feet.

The first step in creating the storage compartment is to place a template having the same shape and dimensions as the perimeter defined by the side walls, top wall and bottom wall of the cabinet between adjacent studs. Then a portion of the wall, e.g. sheetrock defined by the template is cut out or traced out then cut out° using a knife or other cutting object. Into the space formed by removal of the cut out wall portion is inserted the cabinet. It is secured to the wall by screwing screws into the studs through the holes in the rim. The edge of the rim abuts against the edges of the uneven sheetrock. After that a cabinet door may be installed or adjustable shelves or both.

The storage compartment is ideal as a pantry for a kitchen, as a broom closet or a paint storage locker, for example. The method can be applied to any interior sheetrock wall not containing wires or pipes and can be adapted to wood or metal studs.

DETAILED DESCRIPTION OF THE PREFERRED EMBODIMENTS

In order to carry out the method of the invention the user must first find the general area of a wall in which a storage space is desired and then within that area locate adjacent studs. In relatively modern homes walls are usually made of sheetrock. The studs are about 2 inches wide and run vertically inside the walls spaced apart 16 inches from center to center thereby leaving about 14 inches of usable space therebetween at a depth of about 4½ inches. The height of such usable space is generally from about 2 to 6 feet.

Figure 1:
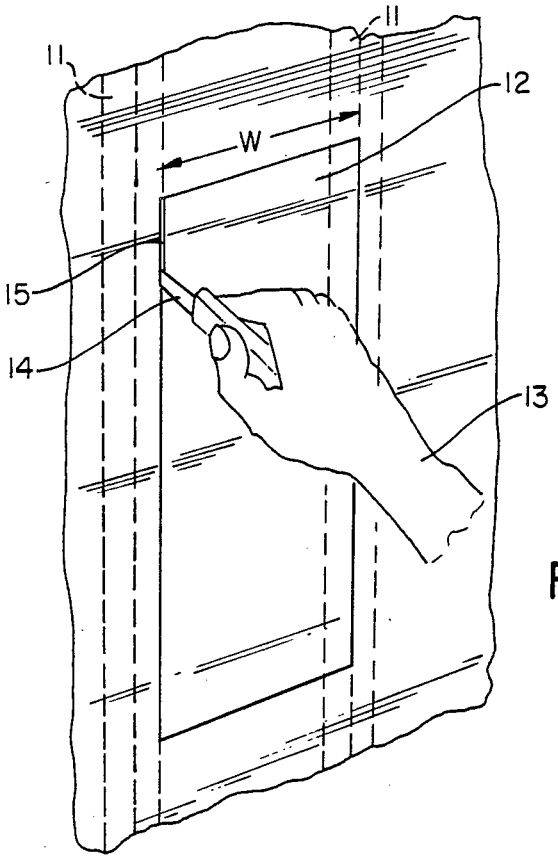
FIG. 1 shows a template being used to cut out a section of a wall.

Referring to the drawings and particularly to FIG. 1 the first step of providing usable storage space according to the invention is to remove a section of wall covering the space to be used. In most newer home constructions the sheetrock wall is nailed between the studs at their midpoint so the location of the studs can often be found quite easily.

Once the wall studs 11 have been located, a template 12 having lines defining a width W of about 14 inches is placed over adjacent studs so that the inner width covers the wallboard section 15 between studs. The template height h can be between about 2 feet and 6 feet for example depending on the height of the storage desired. The wallboard section 15 may be cut out directly from the template which is shown in FIG. 1 by the user 13 cutting around the template 12 with knife 14. Alternatively, just the inner width w can be cut out using the template and the user can cut the length desired with a knife along the inside walls of the studs.

Figure 2:
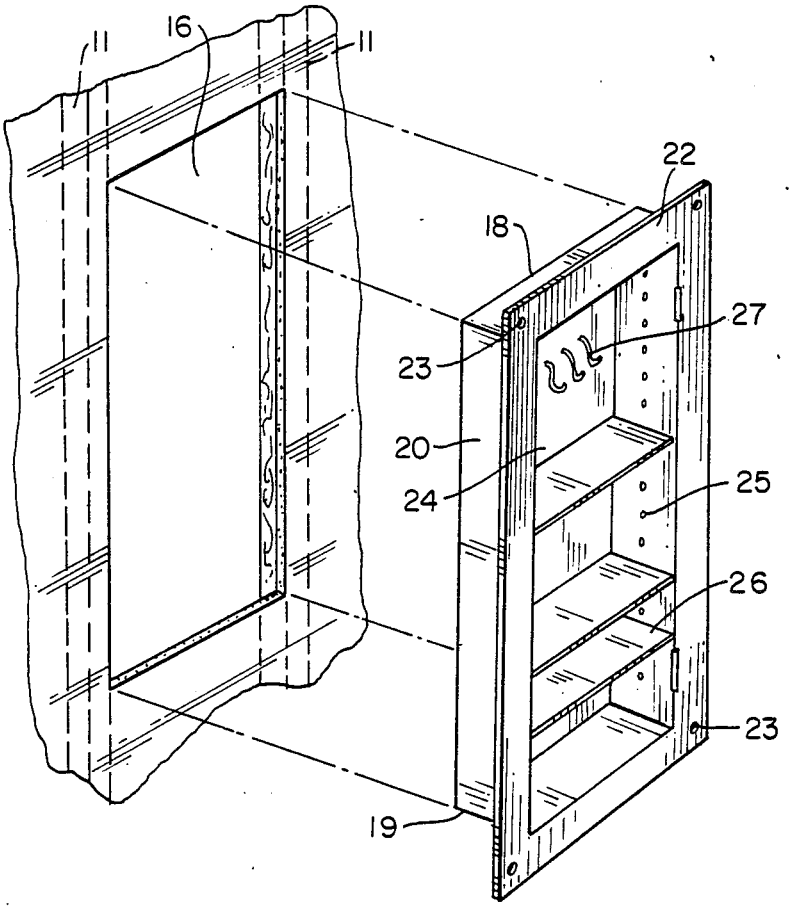
FIG. 2 is an exploded view of a cabinet being placed in the space formed by cutting out the section of wall as in FIG. 1.

In FIG. 2 the section 15 of wallboard has been removed exposing the inside center portions of each stud and forming a space 16 equal to the height of the template having a depth of about 4½ inches. Into this space can be inserted storage cabinet 17. Such cabinet is preferably made of high impact styrene plastic. Cabinet 17, shown in perspective in FIG. 2 is of unitary construction and consists of a top wall 18 and a bottom wall 19, two side walls 20 and 21 and a back wall 24. The distance between side walls is the same as the distance between studs end to end, that is about 14 inches. The depth of the side walls are about the same as the depth of the studs, i.e. 4½ inches. A rim 22 extends around the perimeter of the front of the cabinet outwardly of the walls by about 2 inches. At their corners are located four (4) screw holes 23. On the inside surfaces of each side wall 20 and 21 may be located shelf supports 22 for supporting adjustable shelves 26. The back wall 24 may also have mounted therein hooks 27 for holding articles inside the cabinet. Door hinges 28 are also located on the rim 22.

Figure 3:
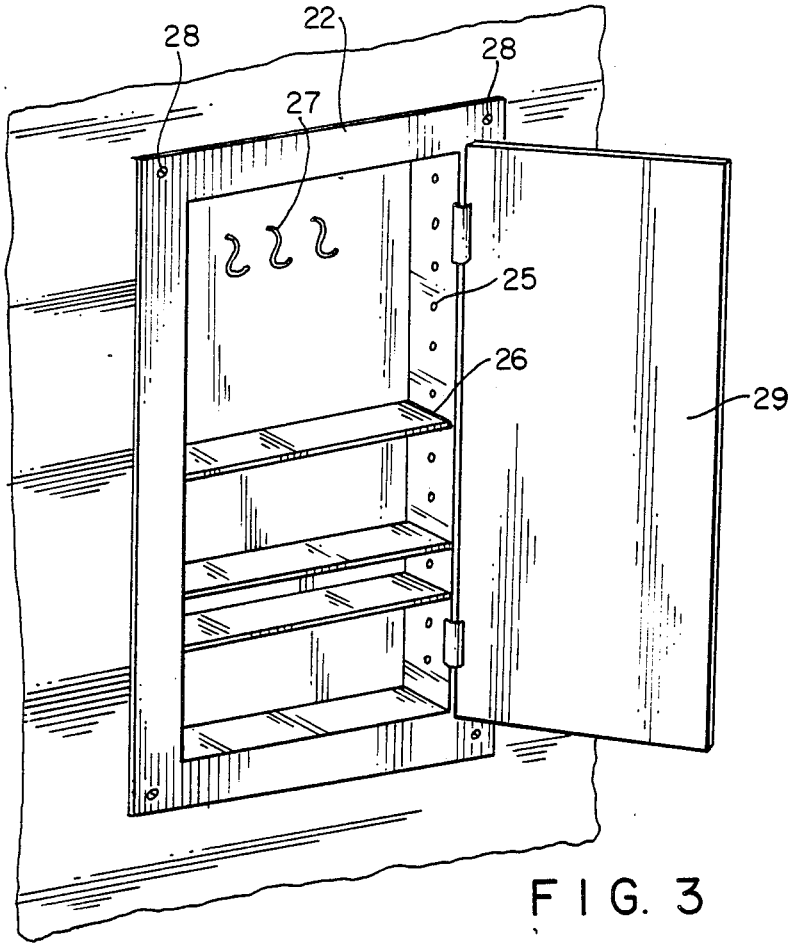
FIG. 3 is a view of the cabinet in place in the wall between studs.

The cabinet 17 is then inserted into the cut-out space as shown in FIG. 3. Screws 28 are passed through holes 23 in the rim 22 and screwed into the studs. At the same time door 29 is then optionally placed on the hinges to make a durable cabinet.

Figure 4:
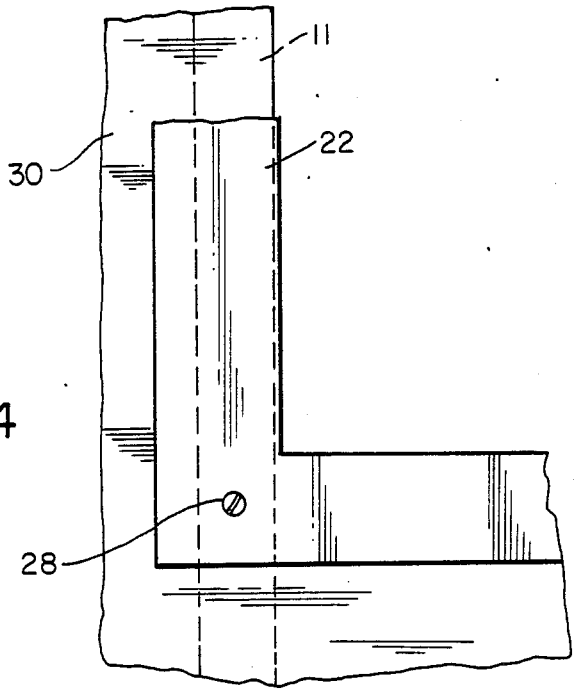
FIG. 4 is a sectional view of a wall having a cabinet installed therein showing the cabinet sides meeting the wall material.

FIG. 4 shows the position of rim 22 on the stud 11. The rim 22 occupies the inside portion of the stud and abuts against the inner edge of the uncut wallboard 30.

I claim:

1. An apparatus for providing a pantry storage compartment in the cavity of a wall, said cavity defined by the space between adjacent studs in said wall and the depth of said studs comprising:

(a) a unitary plastic cabinet fittable within said cavity between said studs and extending to the depth of said studs in said wall having fixed or adjustable shelves and a rim portion extending outwardly around said cabinet and across a portion of the width of said studs, said rim portion having holes for mounting said cabinet to said studs; and (b) a template for outlining said cavity between said studs against the wall to permit cutting of said wall to expose said cavity.

2. The apparatus of claim 1 wherein a door is pivotably mounted on said cabinet.

* * * * *